US009057491B2

(12) United States Patent
Lee

(10) Patent No.: US 9,057,491 B2
(45) Date of Patent: Jun. 16, 2015

(54) NETWORK CONTROLLED INTERIOR LIGHTING SYSTEM

(75) Inventor: Ke-chin Lee, Taipei (CN)

(73) Assignee: Zhongshan Weiqiang Technology Co., Ltd., Zhongshan, Guangdong (CN)

( * ) Notice: Subject to any disclaimer, the term of this patent is extended or adjusted under 35 U.S.C. 154(b) by 720 days.

(21) Appl. No.: 13/419,822

(22) Filed: Mar. 14, 2012

(65) Prior Publication Data

US 2012/0235580 A1 Sep. 20, 2012

(30) Foreign Application Priority Data

Mar. 15, 2011 (CN) ..... 2011 1 0062073

(51) Int. Cl.

| | |
|---|---|
| ***H05B 37/02*** | (2006.01) |
| ***F21S 2/00*** | (2006.01) |
| ***F21V 14/06*** | (2006.01) |
| ***F21V 21/15*** | (2006.01) |
| ***F21V 23/04*** | (2006.01) |
| ***H05B 33/08*** | (2006.01) |
| *F21Y 101/02* | (2006.01) |

(52) U.S. Cl.

CPC . *F21S 2/00* (2013.01); *F21V 14/06* (2013.01); *F21V 21/15* (2013.01); *F21V 23/0435* (2013.01); *F21Y 2101/02* (2013.01); *H05B 33/0854* (2013.01); *H05B 37/0227* (2013.01); *H05B 37/0254* (2013.01); *H05B 37/0272* (2013.01)

(58) Field of Classification Search

USPC ..... 327/150, 152, 153, 155

See application file for complete search history.

(56) References Cited

U.S. PATENT DOCUMENTS

| | | | | |
|---|---|---|---|---|
| 8,834,009 | B2 * | 9/2014 | Chien | 362/642 |
| 2004/0090524 | A1 * | 5/2004 | Belliveau | 348/102 |
| 2008/0151052 | A1 * | 6/2008 | Erel et al. | 348/143 |
| 2010/0141153 | A1 * | 6/2010 | Recker et al. | 315/149 |
| 2012/0121244 | A1 * | 5/2012 | Stavely | 396/175 |
| 2012/0235579 | A1 * | 9/2012 | Chemel et al. | 315/152 |
| 2012/0236270 | A1 * | 9/2012 | Maruyama | 353/101 |
| 2012/0313526 | A1 * | 12/2012 | Lee et al. | 315/113 |
| 2013/0208481 | A1 * | 8/2013 | Sooferian | 362/280 |
| 2014/0226325 | A1 * | 8/2014 | Allen et al. | 362/231 |

* cited by examiner

*Primary Examiner* — William Hernandez

(74) *Attorney, Agent, or Firm* — Andrew W. Chu; Craft Chu PLLC

(57) ABSTRACT

A network controlled indoor lighting system is disclosed, which is constructed based on a device control unit with network connectivity, and a remote controller containing the software for users to control the interior lighting system. The system allows users to control a plurality of LED lamps in terms of brightness, color temperature, beam angle and illumination direction. The system has single/multi-point control, and online error diagnosis.

13 Claims, 6 Drawing Sheets

NETWORK CONTROLLED INTERIOR LIGHTING SYSTEM

The instant application claims benefit to China Ser. No. 201110062073.X filed 15 Mar. 2011, the content of which is incorporated by reference herein in entirety.

FIELD

Ads The present invention relates to a control system for home lighting lamps, and more particularly to a system for controlling the lighting lamps via a network platform.

BACKGROUND

For conventional incandescent bulbs, every watt of electricity consumed usually generates 10 lumens of luminous flux, whereas, according to LED manufacturers, every watt of electricity consumed by LEDs is able to generate up to 160 lumens of luminous flux. However, in practice, limited by shape and maximum working temperature, LED lamps are unable to reach their full potential. Nevertheless, at present, the best LED lamps in the market usually can reach 80-100 lumens per watt. In addition, in comparison with LED lamps, CFL lamps, which may reach 60-70 lumens per watt, have limited potential for future development, and the materials used therein may harm the environment.

It can be seen from above that, the LED lamps are more efficient than CFL lamps, as well as being more compatible with the environment. With growing awareness of environmental issues including global warming and climate change, resource and energy savings are increasingly essential for future product and marketing strategies.

Thus, the advantages of LED technology meet the requirements of the public for safe, energy saving, and environmentally protective lighting solutions. LEDs have other advantages, such as, higher light intensity, longer service time, and smaller dimension, taking into account, design, color, lifetime and cost. The deployment of LED light sources, which are compatible in terms of optics, electrics, mechanics and thermotics, to replace conventional lighting solutions, is an emerging application.

At present, in the commercial, office, and home lighting markets, implementation of LED lamps still face hurdles, including light intensity, color temperature, beam angle, illumination direction, single/multiple point control, and when controlled by a centralized operator or a network, online error diagnostic.

Thus, how to effectively and efficiently solve those essential technical problems has been a key point for the popularization of LED lamps in the market.

Based on the circumstances described above, and focusing on the issue of controlling a variety of parameters of LED lamps controlled via a network, the present invention discloses a network control lighting system for indoor use, which will be described in detail below.

SUMMARY

An objective of the present invention is to provide an interior lighting system, which connects the interior LED lamps together to form a local network, and to allow users to control the LED lamps via a remote controller.

A network controlled interior lighting system, comprises:

at least one LED lamp, comprising at least an LED module, a lens for allowing the light of the LED module to pass through, an angle adjusting device for controlling the distance between the LED module and lens, a direction adjusting device for controlling the direction of the LED lamp, and a microprocessor for central controlling, wherein the LED module comprises at least a red, a green and a blue primary color (RGB) light sources;

a remote controller with wireless network connectivity, as a system control terminal; and a device control unit with wire and/or wireless network connectivity, connected with the LED module, wherein the device control unit receives the control signals from the remote controller via the network, and transmits the instructions to the LED lamp based on the control signals received, to control the LED lamp to perform at least one of the following operations:

(1) light intensity adjustment: by controlling the current through the power supply circuit of the LED module, i.e. increasing or decreasing, to achieve continuous light intensity adjustment of the LED lamp;

(2) color temperature adjustment: by at least respectively controlling the drive currents of the RGB light sources, to adjust the color temperature of the light of the LED lamp;

(3) beam angle adjustment: by driving the angle adjustment device to adjust the distance between the lens and LED module, to adjust the beam angle;

(4) illumination direction adjustment: by driving the direction adjustment device to adjust the direction of the LED lamp, to adjust the illumination direction; and (5) light intensity control: by controlling the drive current through the power supply circuit of the LED module, to adjust the light intensity of the LED lamp to decrease or increase continuously within a predetermined time period, so as to allow the LED lamp to be adjusted to its brightest level, or darkest level, including turnoff.

The LED lamp in the present invention can be lighting lamps mounted in any position within a house, and by centrally connecting the lamps to a device control unit, the system according to the present invention realizes a home lighting network, and hereby allows users to control the lamps simply via a remote controller which serves a network terminal.

The remote controller may be a handheld device, a mobile phone, a PDA, a computer and so on. The user may download the software dedicated for the system into the remote controller, or enter a specific code of the system, to control an LED lamp in the system.

Wherein, the device control unit comprises a main processor and a hub and/or access point (HUB/AP) device, the main processor is connected with the LED lamp via the HUB/AP, for wired or wireless network connection.

Regarding the light intensity adjustment, the LED lamp comprises a brightness adjustment drive circuit on the power supply side of the LED module to realize current adjustment for the LED module; after receiving the instruction for adjusting the light intensity, the microprocessor linearly controls the current supplied to the LED module via the brightness adjustment drive circuit, so as to adjust the light intensity of the LED lamp continuously.

Regarding the color temperature adjustment, the LED module further comprises at least three color-temperature drive circuits, respectively, corresponding to the RGB light sources of the LED module, to realize the respective current adjustments of the RGB light sources. After receiving the instruction for adjusting the color temperature, the microprocessor respectively controls the currents supplied into the RGB light sources via the color-temperature drive circuits so as to adjust the color temperature of the LED module.

Regarding the beam angle adjustment, the angle adjusting device comprises a motor and a transmission, wherein through the transmission, the motor operates to change the relative position of the lens and the LED module and thus, the beam angle of the LED module is changed as the focal point of the light rays refracted by the lens is changed. After receiving the instruction for adjusting the beam angle, the microprocessor adjusts the distance between the lens and LED module via the motor and transmission.

Regarding the illumination direction adjustment, the direction adjusting device comprises a motor group and an angle transmission, the combination of the motor group and the transmission realizes a three-axis range of motion. After receiving the instruction for adjusting the illumination direction, the microprocessor adjusts the direction of the LED lamp via the motor group and transmission.

The remote controller is able to control one or more LED lamps simultaneously, realizing single/multiple point control, if there is only one LED lamp in the house, via the remote controller 200, see for example, FIG. 1, user could simply select to control, realizing the control functions associated with the LED lamp only, but if there are more than one LED lamp available in the house and some of them are required to change their states simultaneously, user may select the set of the LED lamps which need to be controlled, with related commands, to control operation of the LED lamps selected, hereby realizing unified control of the plural lamps.

As a further improvement of the technical scheme described above, the LED lamp further comprises a fault diagnosis module connected to the parts thereof; the fault diagnosis module provides feedback to the device control unit in event of lamp failure, for example, including sending a message or an e-mail to the user.

As a further improvement of the technical scheme described above, the LED lamp further comprises a detection sensor and a temperature sensor, the detection sensor detects the number of people within the illumination area of the LED lamp, and transmits the related data to the microprocessor. The microprocessor then automatically adjusts the light intensity of the LED module based on the data received. In a similar way, the temperature sensor detects a change of the ambient temperature, and transmits the related data to the microprocessor. The microprocessor then automatically adjusts the color temperature of the LED module based on the data received.

The beneficial effects of the present invention include: the control signal is transmitted to the device control unit from the remote controller through the network, and the device control unit then outputs the corresponding instruction to control the one or more LED lamps within the system in terms of light intensity, color temperature, beam angle and illumination angle, the system of the present invention is fully functional, and convenient for users to centrally manage the lighting system. Thus, it can be said that the present invention combines the convenience of the existing network platform and the development tendency of LED technology, thereby allowing management of an LED lighting system to become more intuitional and human-oriented, as well as providing better user experiences. In addition, the extra function of light intensity and color temperature automatic adjustment makes the LED lighting system more human-oriented and energy-saving as well.

BRIEF DESCRIPTION OF THE FIGURES

The following description of the figures and the respective drawings are non-limiting examples that depict various embodiments that exemplify the present invention.

DETAILED DESCRIPTION

Figure 1:
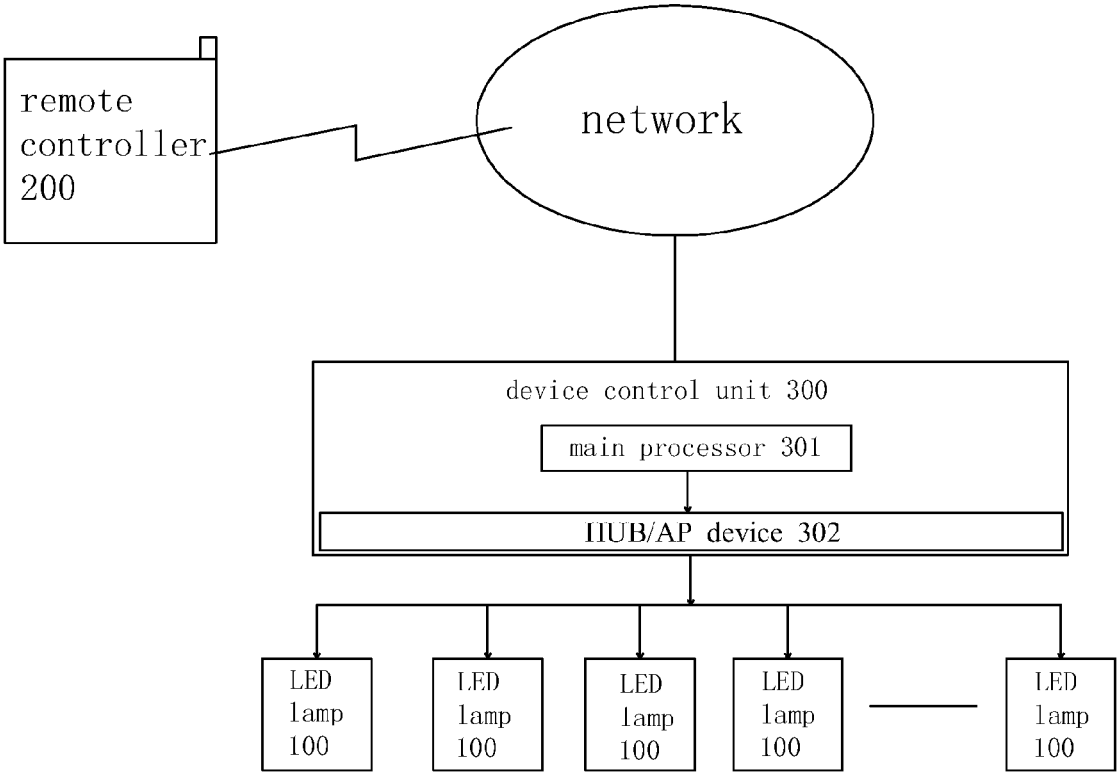
FIG. 1 is a schematic view of the topological structure of the system of the invention.

The network controlled interior lighting system disclosed by the present invention focuses on the network ability for interior LED lamp control. In general, a house usually has one or more lamps mounted in different positions. However, in the control schemes disclosed in the prior art, one control device is usually dedicated to one lamp, which are cumbersome, wastes resources, is not energy efficient and does not reduce emissions. To address the above problems, the present invention provides an interior lighting system, generally as shown by FIG. 1, of which physical structure comprises:

at least one LED lamp 100, mounted inside the house, the LED lamp 100 comprises at least one LED module 110, a lens 120 for allowing the light of the LED module 100 to pass through, an angle adjusting device 130 for controlling the distance between the LED module 110 and the lens 120, a direction adjusting device 140 for controlling the illumination direction of the LED lamp 100, and a microprocessor 150 for central controlling; wherein, the LED module comprises a red LED light source 111, a green LED light source 112 and a blue LED light source 113 (which are collectively called RGB light sources hereinafter);

a remote controller 200 with wireless network connectivity, serving as the system control terminal, it may be a mobile phone, a handheld device, for example, a PDA, or a computer, for example, PC, netbook, etc., by downloading the software dedicated for the present invention into the remote controller 200, and entering the given control codes, or through other specific registration means, the user pairs the remote controller 200 and the lighting system, and enters instructions on the remote controller 200 to control the LED lamp(s) 100 within the house; and a device control unit 300, with wired and/or wireless network connectivity, and connected with the LED lamp 100 of the system, in a typical technical scheme the device control unit 300 comprises a main processor 301, for example, a desktop computer or industrial control computer, and a HUB/AP device 302, the main processor 301 is connected to the LED lamp of the system via the HUB/AP device 302 in a wired or wireless manner, to achieve the data transmission for remote control.

In the present invention, the user may enter a variety of commands on the remote controller 200, the commands entered are transmitted via the existing network, for example, the mobile communication networks including GSM, GPRS, 3G, or the Internet, and received by the device control unit 300; based on the control signals received, the device control unit 300 further sends the corresponding instruction signals to the corresponding LED lamp(s); the instruction signals received in the LED lamp are resolved by the microprocessors 150, to control the LED lamp 100 to change its operating state In the present invention, through hardware expansion, the remote controller 200 may control one or more LED lamps within the system, respectively or in group. If there is only one LED lamp in the house, the user could select to control that LEF via a remote controller 200, realizing the functions associated with the LED lamp only. If there are more than one LED lamp in the house and some, the user may select the particular one or more LED lamps needed to be controlled, which may occur simultaneously, with related commands, to control the plural LED lamps, thereby realizing unified control.

Figure 2:
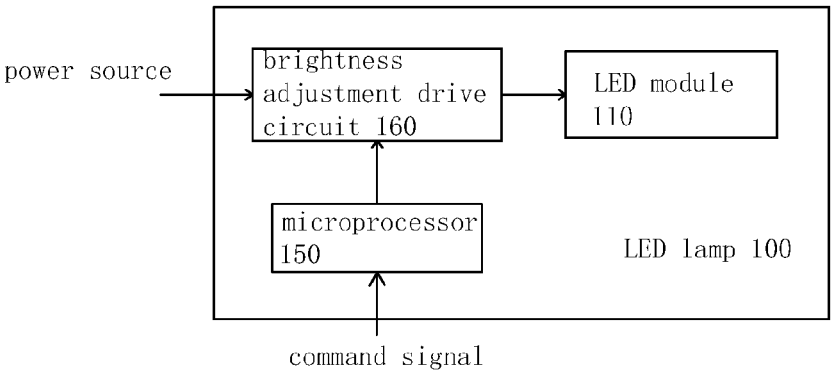
FIG. 2 is a circuit block diagram of the LED lamp of the invention.
Figure 3:
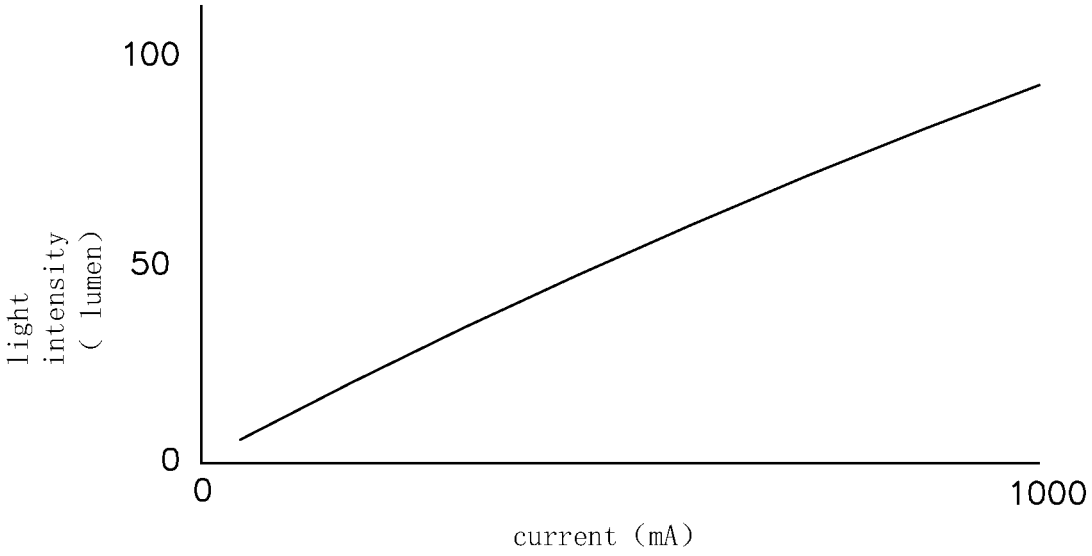
FIG. 3 is a diagram showing the relationship between the current value and the light intensity of the LED light source.
Figure 4:
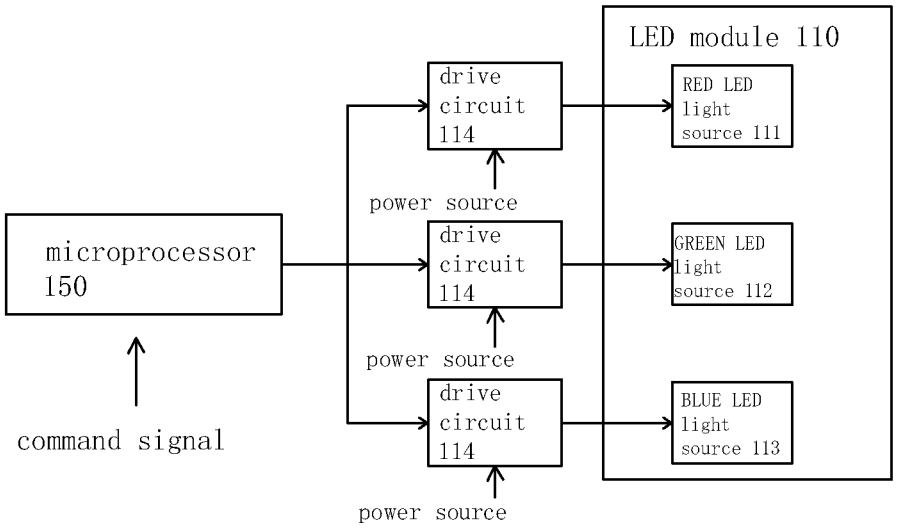
FIG. 4 is a circuit block diagram of the LED lamp in an embodiment of the invention.

Based on the system solution provided by the present invention, the realizable functions include:

1. Light Intensity Adjustment:

The remote controller 200 is operable to control the light intensity of the LED lamp 100, in a continuous manner. In the embodiment shown by FIG. 2, the LED lamp 100 comprises a brightness adjustment drive circuit 160, which is to directly control the drive current on the LED module 110, and in theory the brightness adjustment drive circuit 160 may be located in the input side of the LED module 110, and connected to and controlled by the microprocessor 150. When the user enters a related command on the remote controller 200 (for example, increasing or decreasing the brightness, which are directly reflected in the ports of the remote controller 200), the device control unit 300 receives the corresponding signal and transmits the corresponding instruction to the microprocessor 150 of the LED lamp 100. The microprocessor 150 recognizes the instruction and sends a correct control signal to the brightness adjustment drive circuit 160. As shown by FIG. 3, from the linear relationship between the LED light source and the working current input, it is known that the linear continuous adjustment of the current on the LED module 110 can be achieved by the brightness adjustment drive circuit 160 before the LED module 110, whereby the light intensity of the LED module 110 is adjustable in a continuous manner (decreasing or increasing).

2. Color Temperature Adjustment

The basic principle of the color temperature control by the remote controller 200 for the LED lamp 100 lies in that the three-primary-color LED light sources (RGB light sources) in the LED module 110, i.e., the red LED light source 111, green LED light source 112, and blue LED light source 113, emit light beams with different wavelengths, the final color of the LED module 100 is made of these three different colors of light mixed together, and the color temperature of the LED light source of each primary color is associated with its brightness. Thus, the present invention, by controlling the RGB light sources in brightness, i.e. by placing a drive circuit 114 for color temperature adjustment in the power input side of each RGB light source, and respectively controlling the output currents of the drive circuits 114, gains the three-primary-color light beams with various brightness. The light beams are superimposed to generate light with various color temperatures and blends eventually.

For example, in an embodiment of the present invention, the red, green and blue LED light sources 111, 112 and 113 can be set to generate light with wavelengths in the ranges of 615-620 nm, 460-470 nm, and 460-470 nm respectively. When the user enters a related command, for example, decreasing the color temperature, on the remote controller 200, the command is transmitted to the device control unit 300 through the network, and the device control unit 300 sends the corresponding instruction to the microprocessor 150 of the specified LED lamp 100, for example, to increase the light intensity of the red light source 111, or decrease the light intensity of the blue light source 113, thereby realizing the effect of decreasing the color temperature and hence, the color of light emitted by the LED lamp 100.

3. Beam Angle Adjustment

Figure 5:
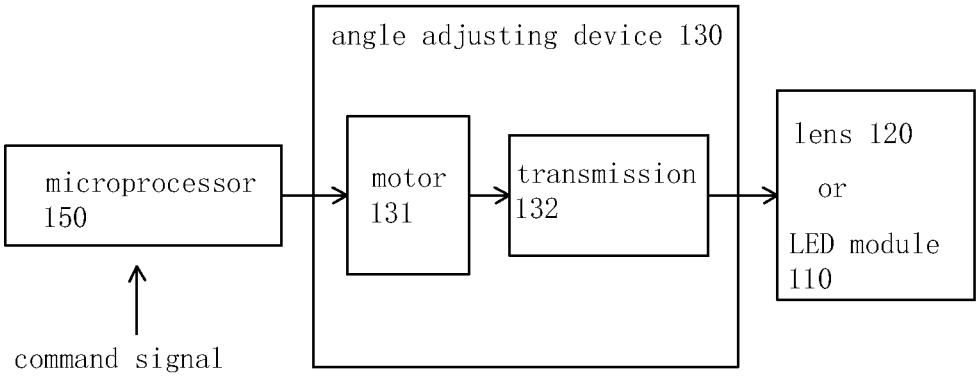
FIG. 5 is a functional block diagram of the angle adjusting device in an embodiment of the invention.
Figure 6:
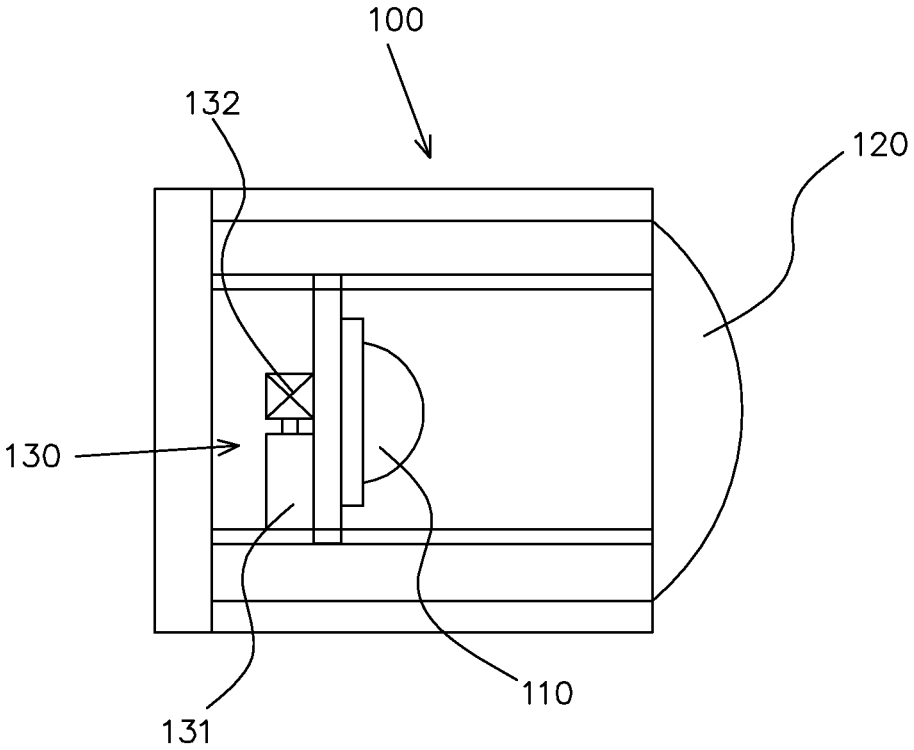
FIG. 6 is a schematic view of the LED lamp in an embodiment of the invention.
Figure 7:
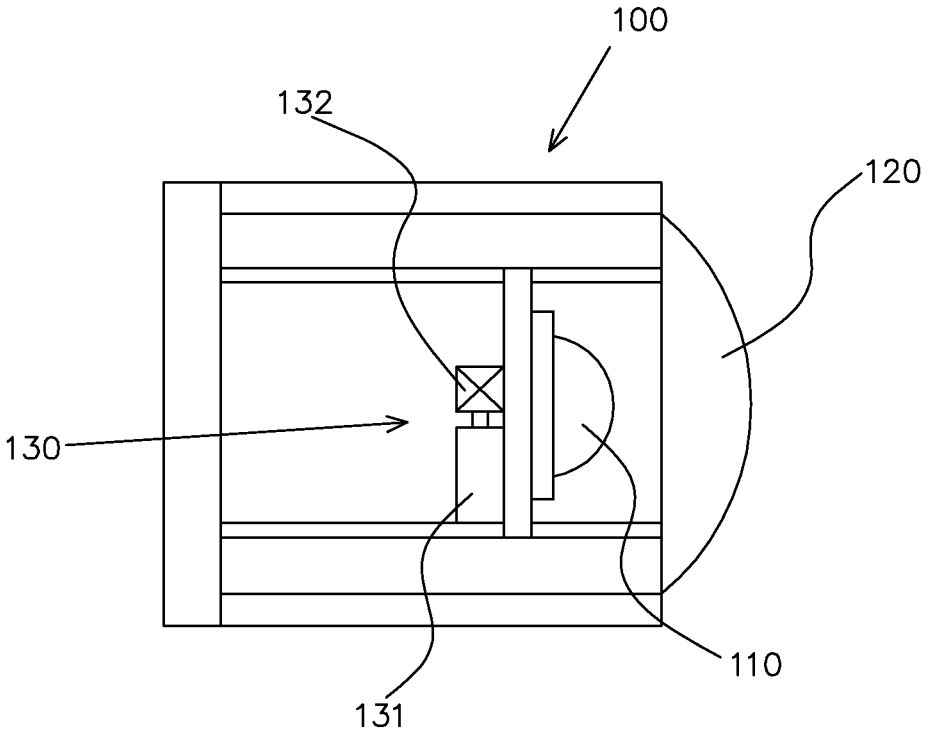
FIG. 7 is a schematic view of the LED lamp in FIG. 6 in another state.

The beam angle mentioned in the present invention refers to the angle of the light emitted by the LED lamp 100, of which reflection in the luminous environment is the coverage area of the light. The solution adopted by the present invention consists of an angle adjusting device 130, as shown by FIGS. 5-7, a typical angle adjusting device 130 adopts the combination of a motor 131 and a transmission 132, to control the relative movement of the lens 120 and/or LED module 110, so as to adjust the distance between them. As the light emitted by the LED module 110 is refracted by the lens 120 into the environment, the relative position of the lens 120 to the LED module 110 is associated with the refraction angle of the light. Thus, by adjusting the distance between the lens 120 and LED module 110, the beam angle adjustment of the LED lamp 100 is achieved. In detail, while the user enters a related command on the remote controller 200, for example, increasing the beam angle of an LED lamp 100, the device control unit 300 receives the control signal from the remote controller 200 and sends the corresponding instruction to the specified LED lamp 100, the microprocessor 150 of the LED lamp 100 controls the motor 131 of the angle adjusting device 130 to rotate forward or backward, as shown by FIG. 7, to further drive the lens 120 and/or LED module 110 to move closer to each other via the transmission 132, to increase the illumination angle of the light of the LED module 110 refracted by the lens 120, thereby to increase the beam angle of the LED lamp 100. This embodiment allows continues adjustment, and thus provides convenience for the user to adjust the beam angle arbitrarily.

4. Illumination Direction Adjustment

Figure 8:
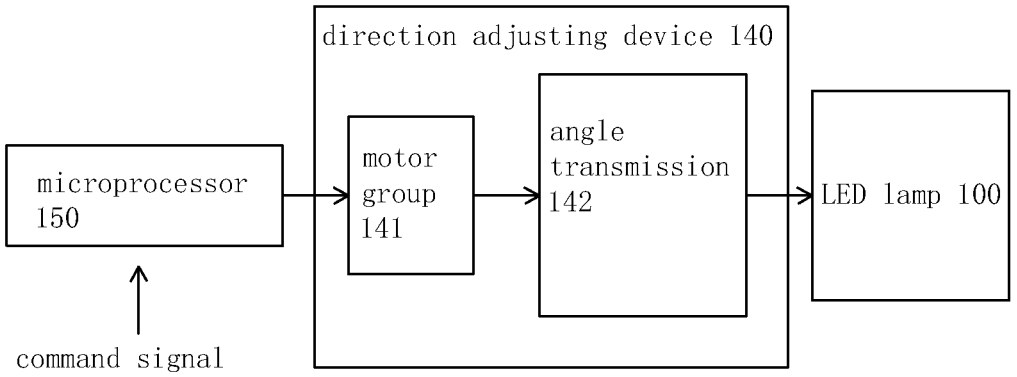
FIG. 8 is a functional block diagram of the direction adjusting device in an embodiment of the invention.
Figure 9:
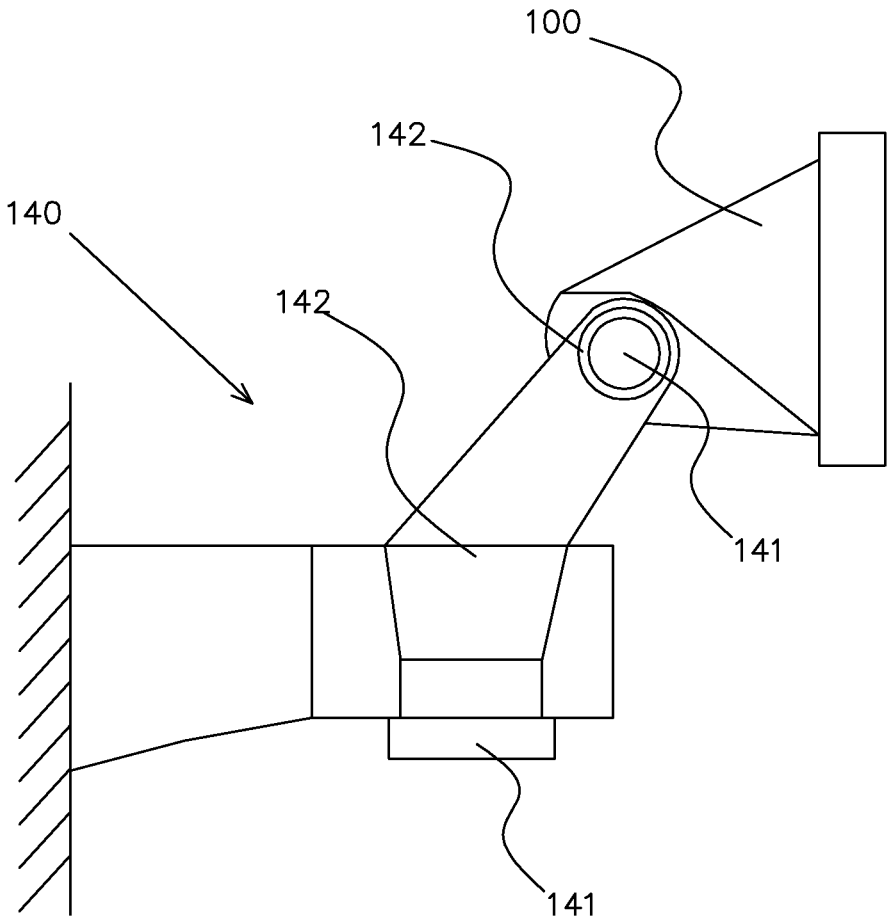
FIG. 9 is a schematic view of the LED lamp with the direction adjusting device in an embodiment of the invention.

In the present invention the illumination direction of the LED lamp 100 can be adjusted by a direction adjusting device 140, as shown by FIGS. 8 and 9. The direction adjusting device 140 typically comprises a motor group 141 for providing power, and an angle transmission 142. The body of the LED lamp 100 is fixed by the angle transmission 142. To achieve a wide-angle direction adjustment, the angle transmission 142 at least comprises a simultaneous-control structure for longitudinal and transverse angle adjustment. Correspondingly, the motor group 141 at least comprises the components for longitudinal and transverse driving. In detail, while the user enters a related command on the remote controller 200, for example, controlling an LED lamp 100 to turn towards a specific direction, the device control unit 300 receives the control signal and sends the corresponding instruction to the specified LED lamp 100 through the network. The microprocessor 150 of the LED lamp 100 controls the motor group 141 of the direction adjusting device 140 to rotate towards a specific direction, and driven by the angle transmission 142, the body of the LED lamp 100 is rotated by a specified angle. Thus, illumination direction adjustment is achieved. In the same way, continuous adjustment can be achieved easily with the structure described above, enabling the user to adjust the illumination direction arbitrarily.

5. Error Diagnostic

Figure 10:
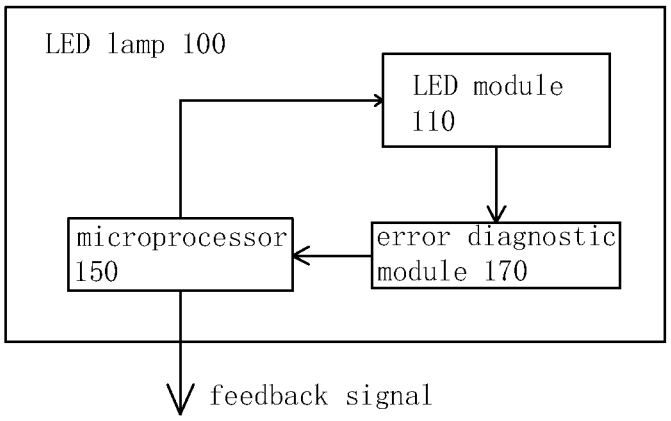
FIG. 10 is a functional block diagram of the LED lamp with an error diagnostic module in an embodiment of the invention.

The system solution of the present invention is of a two-way interaction between the user and the LED terminal, in order words besides the function of allowing the user to control the operation of the LED lamp(s) 100 actively, the system further has the function of allowing the LED lamp 100 to send information back to the user. As shown by FIG. 10, an error or fault diagnostic module 170 is added into the circuit of the LED lamp 100. In theory, one end of the error diagnostic module 170 may be connected with the power supply side, or any part of the LED lamp 100, the other end is connected to the microprocessor 150. In the case of a system or device failure, the error diagnostic module 170 detects the anomalies in time, and sends the related information to the device control unit 300. Based on the information received, the device control unit 300 informs the user to solve the problem, for example, by sending out a message or an e-mail.

6. Light Intensity Automatic Adjustment

Figure 11:
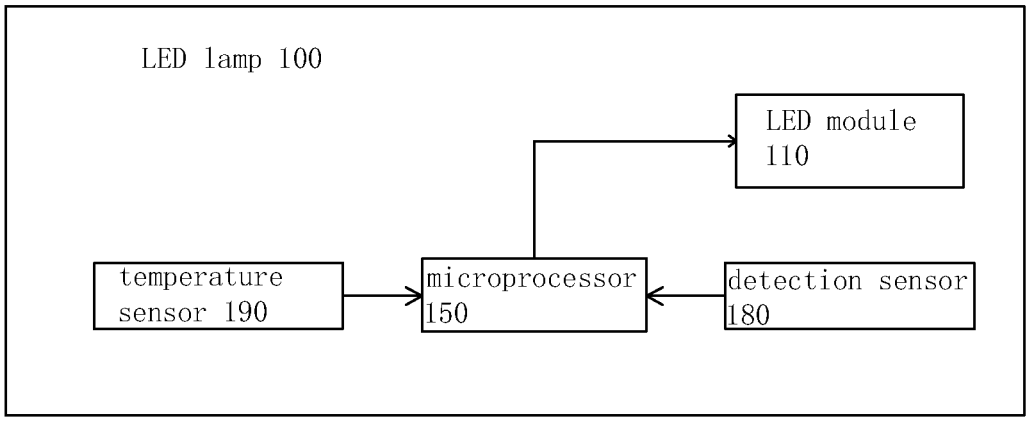
FIG. 11 is a functional block diagram of the LED lamp with a detection sensor and a temperature sensor in an embodiment of the invention.

As shown by FIG. 11, in the present invention, the LED lamp 100 further comprises a detection sensor 180 connected to the microprocessor 150. The detection sensor 180 may be an infrared sensor or an imaging sensor, scanning the illumination area of the LED lamp 100. When the number of people within the area increases and exceeds a predetermined number, for example, three, the detection sensor 180 informs the microprocessor 150 to control the brightness adjustment drive circuit 160 to increase the input current of the LED module 110 so as to increase the light intensity of the LED lamp 100. In contrast, when there are only few people even no one within the area, the microprocessor 150 controls the brightness adjustment drive circuit 160 to decrease the input current of the LED module 110 so as to decrease the light intensity of the LED lamp 100, or even put the LED lamp 100 into a hibernation mode. Through the mechanism described above, an intelligent and automatic adjustment for light intensity is achieved. At the same time, the result of automatic intensity adjustment is fed back to and displayed on the remote controller 200.

7. Color Temperature Automatic Adjustment

As shown by FIG. 10, in the present invention the LED lamp 100 may further comprise a temperature sensor 190 connected to the microprocessor 150, for monitoring ambient temperature change. In detail, when the ambient temperature changes, i.e., decreasing, the temperature sensor 190 informs the microprocessor 150, and the microprocessor 150 then controls the drive circuits 114 to adjust the input current of the RGB light sources, for example, increasing the current on the red light source 111 to increase red brightness. The ultimate influence is reflected in the LED module 110 as decreased color temperature. Thus, the light has a warmer color, making people feel more comfortable.

8. Light Intensity Control

As described above, via the remote controller 200, the user may control the light intensity of the LED lamp 100. In addition, by controlling the drive current on the power supply circuit of the LED module 110, the present invention allows the light intensity of the LED lamp 100 to decrease or increase gradually in a predetermined time period, to the brightest level, or to the darkest level, even turnoff, in a continuous manner. This function enables the light intensity of the LED lamp to gradually change in a predetermined time length, for example, while the user is sleeping. The LED lamp could be set to dim to off in a half hour, this process is fully automatic, convenient and user-friendly.

It should be understood that the above descriptions only disclose some of the most common embodiments of the present invention. Due to differences among specific environments and use conditions of indoor lighting, based on the system framework disclosed by the present invention, the control solution may have many variations. Thus, the system according to the present invention is programmable, a person skilled in the art may program the system according to actual conditions, to update system functions, or match the system with the actual hardware. Furthermore, users may download the latest software into the remote controller 200 and device control unit 300, to match the system with different application environments, and to have richer functions.

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded with the broadest interpretation so as to encompass all such modifications and similar structure.

I claim:

1. A network controlled interior lighting system, comprising:

(1) at least one LED lamp, comprising
at least an LED module, and
one or more of a lens for allowing the light of the LED module to pass through,
an angle adjusting device for controlling the distance between the LED module and the lens,
a direction adjusting device for controlling the direction of the LED lamp, and
a microprocessor for central controlling, wherein the LED module comprises at least a red, a green and a blue primary color (RGB) light source;

(2) a remote controller with wireless network connectivity, as a system control terminal; and (3) a device control unit with wire and/or wireless network connectivity, connected with the LED module, wherein the device control unit receives the control signals from the remote controller through the network, and transmits the instructions to the LED lamp to control the LED lamp to perform at least one of the following operations:

(a) light intensity adjustment by controlling the current through the power supply circuit of the LED module;

(b) color temperature adjustment by at least respectively controlling the drive currents of the RGB light sources;

(c) beam angle adjustment by driving the angle adjustment device to adjust the distance between the lens and LED module;

(d) illumination direction adjustment by driving the direction adjustment device to adjust the direction of the LED lamp; or (e) light intensity control by controlling the drive current through the power supply circuit of the LED module so as to adjust the light intensity of the LED lamp to decrease or increase continuously within a predetermined time period, and wherein the device control unit comprises a main processor and a HUB/AP, the main processor being connected with the LED lamp via the HUB/AP.

2. The interior lighting system according to claim 1, wherein the remote controller may be a handheld device, a mobile phone or a computer.

3. The interior lighting system according to claim 1, wherein the LED lamp comprises a brightness adjustment drive circuit that linearly controls the current supplied to the LED module so as to adjust the light intensity of the LED lamp continuously.

4. The interior lighting system according to claim 1, wherein the LED module further comprises at least three color-temperature drive circuits respectively connected with the RGB light sources of the LED module for adjusting the color temperature of each of the RGB light sources.

5. The interior lighting system according to claim 1, wherein the angle adjusting device comprises a motor and a transmission to adjust the distance between the lens and LED module.

6. The interior lighting system according to claim 1, wherein the direction adjusting device comprises a motor group and an angle transmission to adjust the direction of the LED lamp.

7. The interior lighting system according to claim 1, wherein the remote controller controls one or more LED lamps simultaneously.

8. The interior lighting system according to claim 1, wherein the LED lamp further comprises a fault diagnosis module to provide feedback to the device control unit.

9. The interior lighting system according to claim 1, wherein the LED lamp further comprises a detection sensor, a temperature sensor or both.

10. The interior lighting system of claim 9, wherein the detection sensor detects the number of the people within the illumination area of the LED lamp to adjust the light intensity of the LED module.

11. The interior lighting system of claim 9, wherein the temperature sensor detects a change of ambient temperature to adjust the color temperature of the LED module.

12. The interior lighting system of claim 1, wherein the light intensity control adjusts intensity within a predetermined time period.

13. The interior lighting system of claim 1, wherein the light intensity control extinguishes the light.

* * * * *